US005732639A

United States Patent [19]

Kojima et al.

[11] Patent Number: 5,732,639

[45] Date of Patent: Mar. 31, 1998

[54] RIGHT LOOPER RELEASE MECHANISM IN OVERLOCK SEWING MACHINE

[75] Inventors: Shinji Kojima; Masanori Mizunuma, both of Utsunomiya, Japan

[73] Assignee: The Singer Company N.V., Curaco, Netherlands Antilles

[21] Appl. No.: 693,834

[22] Filed: Aug. 1, 1996

[30] Foreign Application Priority Data

Aug. 9, 1995 [JP] Japan ..... 7-222742

[51] Int. Cl.[6] ..... D05B 57/06

[52] U.S. Cl. ..... 112/162; 112/199

[58] Field of Search ..... 112/199, 162, 112/166, 168, 165, 184, 197, 200

[56] References Cited

U.S. PATENT DOCUMENTS 4,799,440 1/1989 Koshinaka et al. ..... 112/199 X 4,991,525 2/1991 De Santis ..... 112/199

*Primary Examiner*—Peter Nerbun

*Attorney, Agent, or Firm*—McCormick, Paulding & Huber

[57] ABSTRACT

A right looper release mechanism in an overlock sewing machine is disclosed comprising a vertically movable needle having a needle thread, a right looper disposed under the vertically movable needle and reciprocally movable in a direction crossing the vertically movable needle, a rear driving lever attached to the right looper and engaged in a right looper shaft so as to be freely turned relative thereto, a front driving lever fixed to the right looper shaft, a fixing screw member inserted in a throughhole of the front driving lever so as to be freely turned, said fixing screw member having a male screw being screwed into a female screw 3*a* of the rear driving lever so as to transmit a motion of the right looper shaft to the rear driving lever by way of the front driving lever, and an elastic member for elastically biasing the fixing screw member in a direction to release the fixing screw member so as to be unscrewed from the female screw of the rear driving lever.

2 Claims, 5 Drawing Sheets

RIGHT LOOPER RELEASE MECHANISM IN OVERLOCK SEWING MACHINE

BACKGROUND OF THE INVENTION

1. Field of the Invention

The present invention relates to a right looper release mechanism in an overlock sewing machine.

2. Prior Art

A conventional overlock sewing machine comprises a vertically movable needle having a needle thread, an upper side right looper having a right looper thread inserted into a thread hole bored in the upper end thereof, the upper side right looper, operating in a direction perpendicular to the direction of movement of a product to be sewn (workpiece), and a lower side left looper having a left looper thread and swinging right and left, wherein the vertical movable needle, the right looper and the left looper cooperate with one another for performing an overlock stitch.

That is, the conventional overlock sewing machine includes the vertically movable needle having the needle thread, the left looper having the left looper thread and being reciprocally swingably movable to the right and left, and a right looper having a right looper thread and operating while crossing a moving direction of the workpiece, wherein the overlock sewing machine performs an overlock stitch such as one-needle-three thread overlock stitch, or one-needle-two thread overlock stitch, depending on the thickness of the workpiece. For example, the one-needle-three thread overlock stitch is carried out by three threads, namely, the needle threads inserted into the thread hole of the needle, the right thread inserted into the thread hole of the right looper, and the left looper thread inserted into the thread hole of the left looper, and the one-needle-two thread overlock stitch is carried out by two threads, namely, the thread inserted into the thread hole of the needle and thread inserted into the thread hole of the left looper.

When the overlock stitch is changed to a chain stitch, the right looper needs to be released. That is, when a portion apart from an end edge 50*a* of a sewn product 50 is subjected to decorative stitching by way of the chain stitch as shown in FIG. 7, a track L (denoted by broken lines) interferes with the sewn product 50, so that the operation of the right looper 51 needs to be released.

A conventional right looper release mechanism is shown in FIGS. 5 and 6. That is, a rear driving lever 35 is engaged in a right looper shaft 34 so that the former is turned relative to the latter, and a front driving lever 36 is fixed to a tip-end of the right looper shaft 34 by way of a set screw, not shown. A fixing screw member 37 is inserted into a throughhole 36*a* of the front driving lever 36 bored at the side thereof from the front thereof, then a male screw 37*a* of the fixing screw member 37 is screwed into a female screw 35*a* of the rear driving lever 35 as shown in FIG. 5 so that the rear driving lever 35 and the front driving lever 36 are connected with each other. As a result, a turning motion of the right looper shaft 34 in a given angular interval is transmitted to the rear driving lever 35 by way of the front driving lever 36, so that the rear driving lever 35 performs a swinging motion. Thereafter the swinging motion of the rear driving lever 35 is transmitted to the right looper 51 by way of a right looper retainer, not shown, so that the right looper 51 performs a given crossing motion as shown FIG. 7.

The releasing operation of the right looper 51 is performed by loosening the fixing screw member 37 thereby separating the front driving lever 36 from the rear driving lever 35. However, there occurs a case where the retention between the fixing screw member 37 and the rear driving lever 35 is not completely released as shown in FIG. 6 even if the male screw 37*a* of the fixing screw member 37 is merely unscrewed from the female screw 35*a* of the rear driving lever 35. Accordingly, unless the fixing screw member 37 is pulled forward after it is released, so as to sufficiently release the retention between the fixing screw member 37 and the rear driving lever 35, the retention therebetween remains. As a result, erroneous operations caused by this retention occur.

On the other hand, when the right looper 51 is operated, the fixing screw member 37 is tightened and the front driving 36 and the rear driving lever 35 are connected with each other. As a result, when the fixing screw member 37 is sufficiently tightened, deflection is generated, particularly on the rear driving lever 35 which makes the motion of rear driving lever 35 dull. Accordingly, when the right looper 51 is switched to be released or driven, the fixing screw member 37 must be operated carefully, which results in deterioration of the operability.

SUMMARY OF THE INVENTION

The present invention has been made in view of the conventional drawbacks and has the following arrangement.

To achieve the above object, a right looper release mechanism in an overlock sewing machine according to a first aspect of the present invention comprises a vertically movable needle 25 having a needle thread, a right looper 1 disposed under the vertically movable needle 25 and reciprocally movable in a direction crossing the vertically movable needle 25, a rear driving lever 3 attached to the right looper 1 and engaged in a right looper shaft 2 so as to be freely turned relative thereto, a front driving lever 4 fixed to the right looper shaft 2, a fixing screw member 7 inserted in a throughhole 14 of the front driving lever 4 so as to be freely turned, said fixing screw member 7 having a male screw 7*c* being screwed into a female screw 3*a* of the rear driving lever 3 so as to transmit a motion of the right looper shaft 2 to the right looper 1 by way of the front driving lever 4 and the rear driving lever 3, and an elastic member 8 for elastically biasing the fixing screw member 7 in a direction to release the fixing screw member 7 so as to be unscrewed from the female screw 3*a* of the rear driving lever 3.

Further there is provided a right looper release mechanism in an overlock sewing machine according to the second aspect of the invention further comprising a retaining member 9 provided on the fixing screw member 7 wherein the retaining member 9 is retained in front of the rear driving lever 3 for restricting a length of screwing of the male screw 7*c* of the fixing screw member 7 into the female screw 3*a* of the rear driving lever 3.

According to the first aspect of the invention, the operation of the right looper 1 is released when the overlook stitch is changed to the chain stitch so as to prevent a sewn product and the right looper 1 from being interfered with each other. That is, the fixing screw member 7 is turned so as to remove-the male screw 7*c* from the female screw 3*a* of the rear driving lever 3. At this time, the screwing between the male screw 7*c* of the fixing screw member 7 and the female screw 3*a* of the rear driving lever 3 is released so that the fixing screw member 7 is elastically returned forward owing to a repulsive force or resiliency of the elastic member 8.

As a result, it is possible to prevent that the swinging motion of the front driving lever 4 is erroneously transmitted to the rear driving lever 3 by way of the fixing screw member 7. Accordingly, the swinging motion of the rear driving lever 3 is surely stopped, thereby stopping the right looper 1.

According to the second aspect of the invention, when the normal overlock stitch is performed, the rear driving lever 3 is connected with the front driving lever 4. That is, the male screw 7c of the fixing screw member 7 inserted into the throughhole 14 of the front driving lever 4 so as to be freely turned is screwed into the female screw 3a of the rear driving lever 3 so that both rear driving lever 3 and front driving lever 4 are connected with each other. At this time, the retaining member 9 is brought into contact with the front surface of the rear driving lever 3 so that tightening force of the fixing screw member 7 is remarkably increased. As a result, sufficient tightening is carried out, and deflection or deformation of the rear driving lever 3 and front driving lever 4, particularly, those of the rear driving lever 3 is prevented.

In a state where the rear driving lever 3 and the front driving lever 4 are connected with each other, a turning motion of the right looper shaft 2 in a given angular interval is transmitted to the rear driving lever 3 by way of the front driving lever 4 so that the rear driving lever 3 performs the swinging motion. When the swinging motion of the rear driving lever 3 is transmitted to the right looper 1, the right looper 1 performs a given crossing motion. When the operation of the right looper 1 is released, the screwing between the male screw 7c of the fixing screw member 7 and the female screw 3a of the rear driving lever 3 is released, so that the fixing screw member 7 is elastically returned forward owing to the resiliency of the elastic member 8. The position where the fixing screw member 7 is returned is restricted when the retaining member 9 is brought into contact with and retained by the rear surface of the front driving lever 4.

DESCRIPTION OF THE PREFERRED EMBODIMENT

The right looper release mechanism according to the preferred embodiment of the present invention will be now described with reference to FIGS. 1 through 4.

Figure 4:
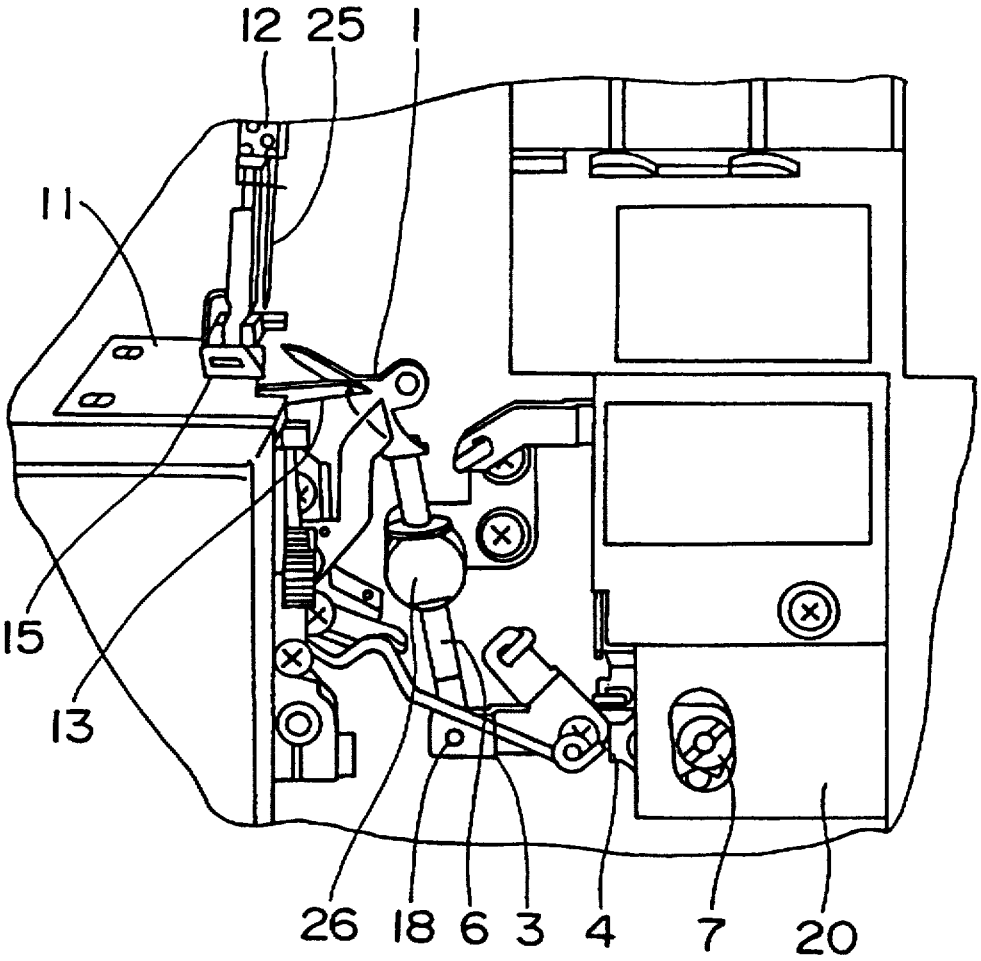
FIG. 4 is a front view showing a main portion of the right looper release mechanism of FIG. 1.
Figure 5:
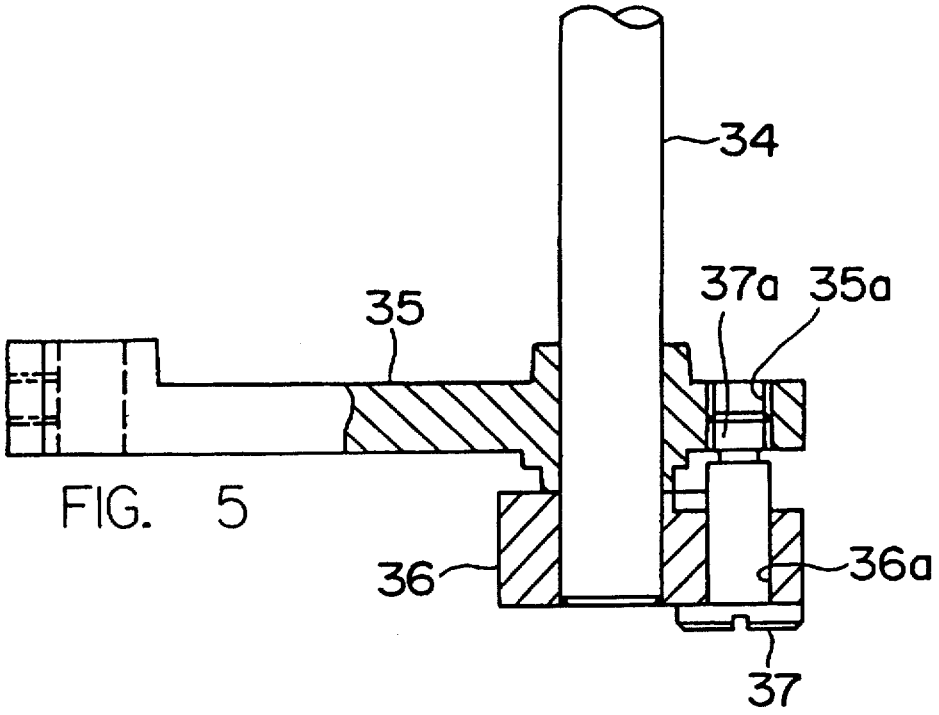
FIG. 5 is a front view of a conventional right looper release mechanism of an overlock sewing machine wherein a part thereof is cut off.
Figure 6:
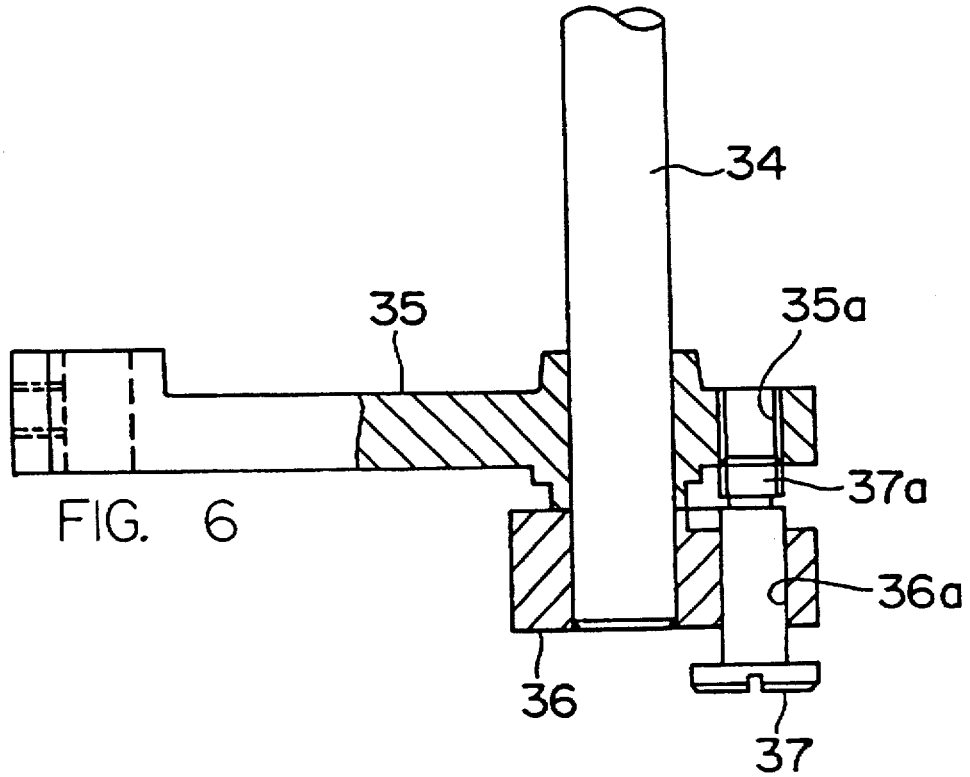
FIG. 6 is a view showing the operation of the right looper release mechanism of the FIG. 5.
Figure 7:
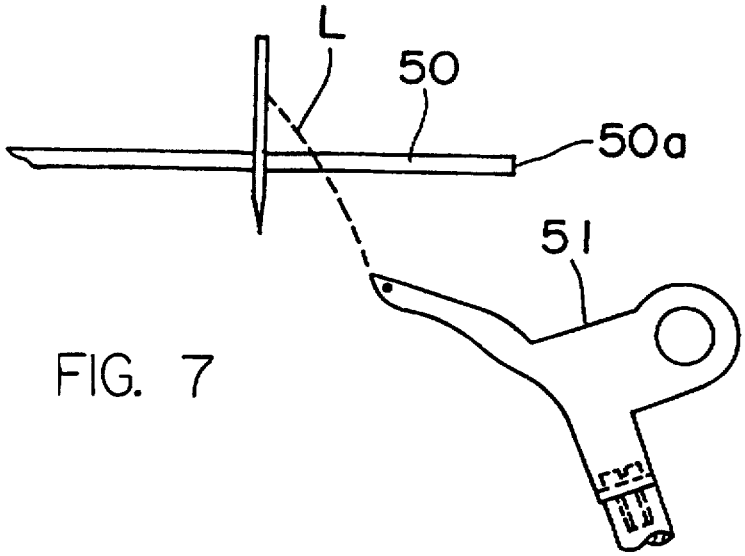
FIG. 7 is a view showing the chain stitching operation of the right looper release mechanism of FIG. 5.

In FIG. 4, denoted by 11 is a bed of an overlock sewing machine through which a needle 25 supported by an arm (not shown) by way of a needle bar 12 is vertically movable, and a left looper 13 and a right looper 1 are respectively disposed under the bed 11 and are arranged below the vertically movable needle 25. Front portions of the left looper 13 and the right looper 1 are covered with a detachable front lid, not shown, and side portions (right side in FIG. 4) are covered with a front cover 20. Meanwhile, the left looper 13, the right looper 1 and the vertically movable needle 25 operate while a workpiece, not shown, is tightened between the bed 11 and a presser foot 15 so as to perform various sewing operations.

Figure 1:
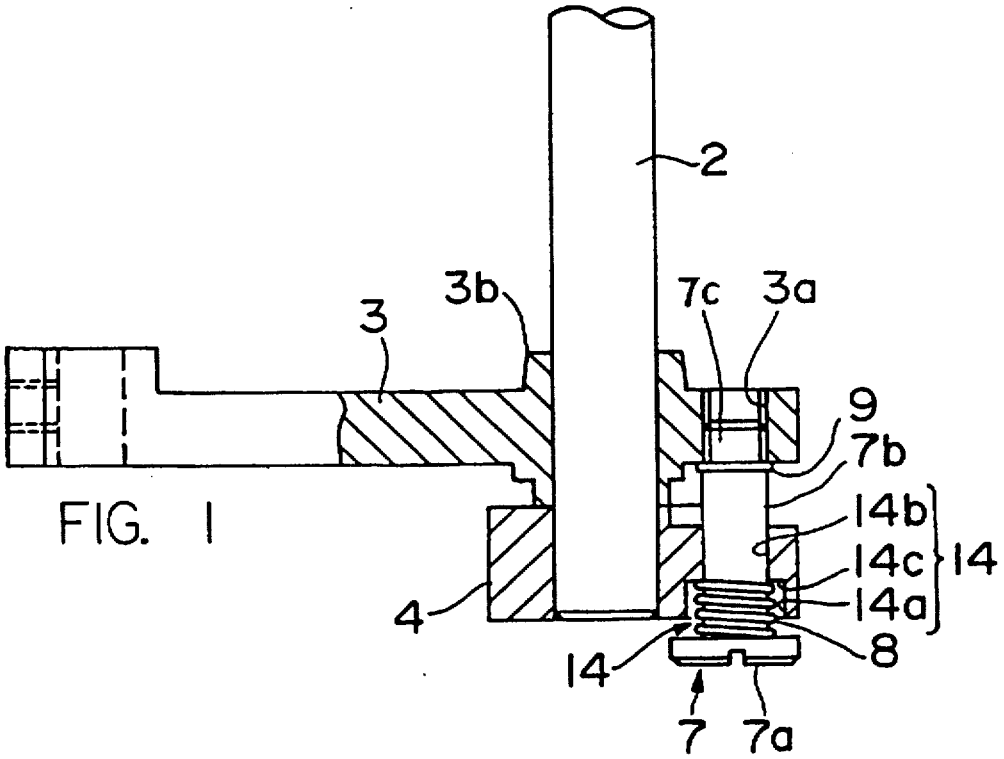
FIG. 1 is a front view of a right looper release mechanism of an overlock sewing machine according to a preferred embodiment of the present invention wherein a part thereof is cut off.
Figure 2:
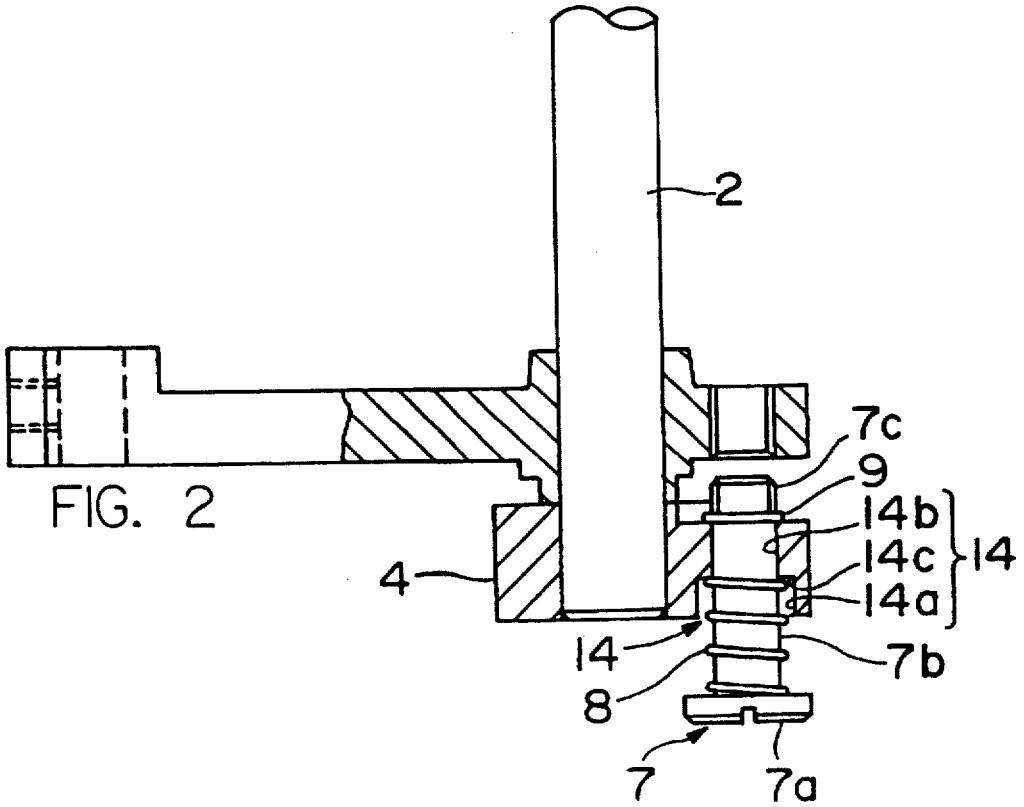
FIG. 2 is a view showing the operation of the right looper release mechanism of the FIG. 1.
Figure 3:
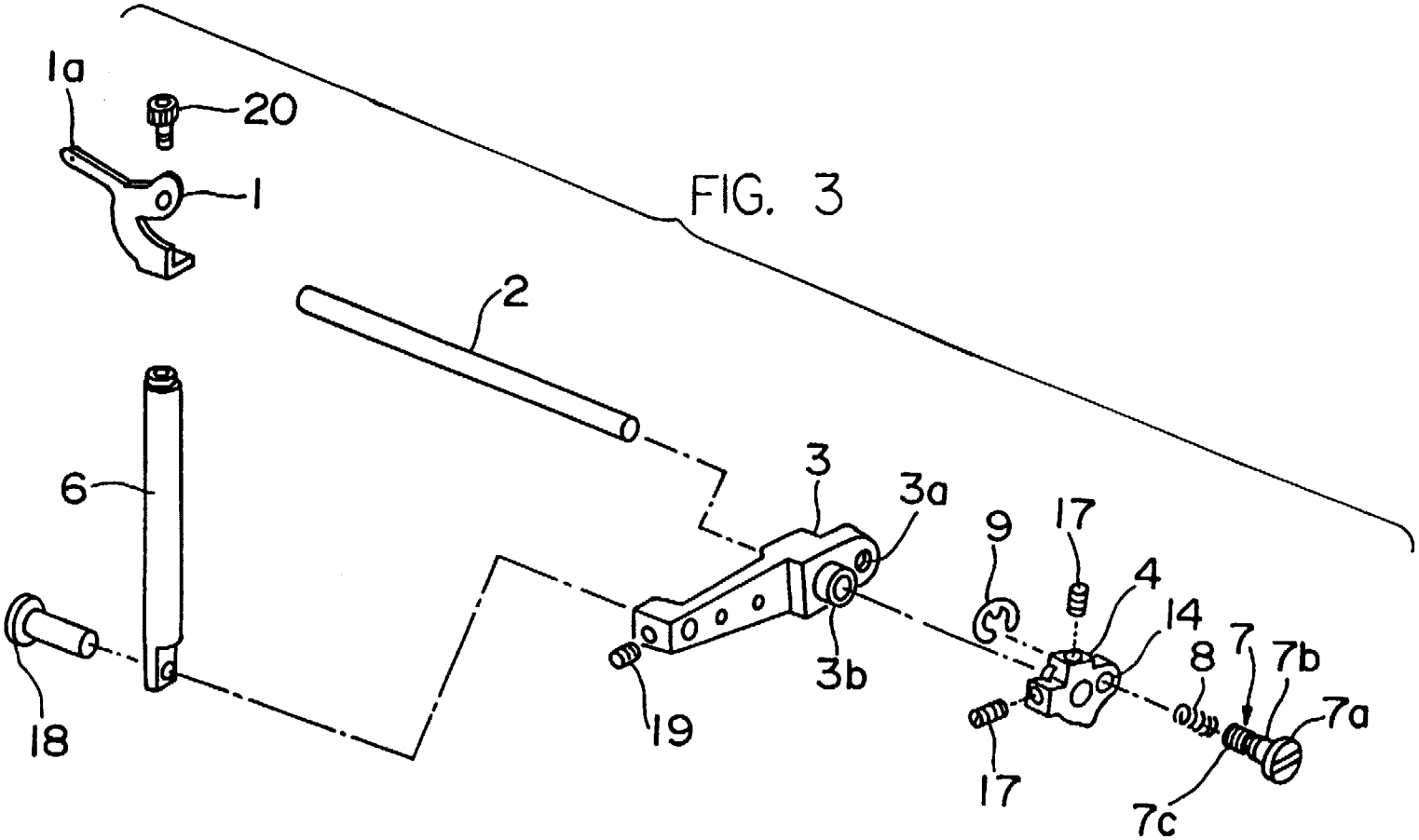
FIG. 3 is an exploded perspective view of the overlook sewing machine of FIG. 1.

An arrangement for attaching the right looper 1 will be now described. As shown in FIGS. 1 and 3, a boss 3b adjacent to a base end of the rear driving lever 3 is engaged into the right looper shaft 2 at a portion adjacent to the tip end thereof which is supported by a body of the overlock sewing machine so as to be freely turned, and the front driving lever 4 is fixed to the tip end of the right looper shaft 2 by a plurality of set screws 17. On the other hand, a looper retainer 6 as shown in FIG. 3 is swingably connected with the tip end of the rear driving lever 3 by way of a pin 18. The pin 18 is fixed to the tip end of the rear driving lever 3 by a set screw 19. The right looper 1 is fixed to the upper end of the looper retainer 6 by a set screw 21. The right looper 1 has a thread hole 1a through which a right looper thread, not shown, is inserted.

A retention release mechanism is provided between the rear driving lever 3 and the front driving lever 4. That is, a throughhole 14 is bored in the side of the front driving lever 4 and comprises a large diameter portion 14a at the front thereof, a small diameter portion 14b at the rear thereof wherein the large and small diameter portions 14a and 14b are connected with each other by way of an annular staged surface 14c. The fixing screw member 7 is inserted into the throughhole 14 from the front portion (this side as viewed by a viewer in FIG. 4). The fixing screw member 7 having a head 7a, a shaft 7b and a male screw 7c formed on the tip end of the shaft 7b wherein the shaft 7b is rotatably supported by the small diameter portion 14b of the throughhole 14. An elastic member, i.e., coil spring 8 is interposed between the head 7a of the fixing screw member 7 and the seat surface 14c. The coil spring 8 is engaged in the shaft 7b of the fixing screw member 7 from the outside so as to elastically bias the fixing screw member 7 forward so that the retention between the male screw 7c and the female screw 3a of the rear driving lever 3 is released.

The female screw 3a of the rear driving lever 3 is formed on the base end of the rear driving lever 3 so as to be confronted with the throughhole 14 so that the male screw 7c of the fixing screw member 7 can be screwed into the female screw 3a. Meanwhile, the male screw 7c of the fixing screw member 7 rotatably attached to the front driving lever 4 is screwed into the female screw 3a of the rear driving 3 so that both driving levers 3 and 4 are connected with each other.

A retaining member 9 comprising an E-ring is provided on the fixing screw member 7 and positioned at a boundary between the shaft 7b and the male screw 7c in a state where the fixing screw member 7 is inserted into the throughhole 14 of the front driving lever 4. The retaining member 9 is retained by the rear surface of the front driving lever 4 so as to prevent the fixing screw member 7, which is biased by the coil spring 8, from coming off, it is also retained by the front surface of the rear driving lever 3 so as to restrict the length of the screwing of the male screw 7c of the fixing screw member 7 into the female screw 3a of the rear driving lever 3. The male screw 7c is sufficiently removed from the female screw 3a in a state where the retaining member 9 is brought into contact with and retained by the rear surface of the front driving lever 4, and is positioned in a space between both levers 4 and 3. It is preferable that the coil spring 8 is slightly compressed in a state where the retaining member 9 is brought into contact with the rear surface of the front driving lever 4 so as to restrain the fixing screw member 7 from being rattled in a state wherein the fixing screw member 7 is released.

The right looper 1 having the right looper thread which is inserted into the thread hole 1*a* thereof cooperates with the left looper 13 having the left looper thread which is inserted into the hole thereof and the vertically movable needle 25 having the needle thread which is inserted into the hole thereof so as to perform the one-needle-three-thread overlock stitch, etc. The motion of the right looper 1 during the sewing operation is generated in such a manner that the normal or reverse turning motion of the right looper shaft 2 in a given angular interval is transmitted to the rear driving lever 3 by way of the front driving lever 4, and also transmitted to the looper retainer 6 by way of the right looper shaft 2 where the turning motion is changed to a vertical motion. Since the looper retainer 6 is slidably supported by a swing member 26 which is swingably fixed to the body of the overlock sewing machine at the intermediate portion thereof as shown in FIG. 4, the looper retainer 6 performs the swinging motion in addition to the vertical motion, so that an operation crossing the moving direction of the workpiece is given to the right looper 1.

The operation of the right looper release mechanism will be described now.

In case of performing an ordinary overlook stitch such as one-needle-three-thread overlock stitch, or one-needle-two-thread overlock stitch, the rear driving lever 3 is connected with the front driving lever 4. That is, the male screw 7*c* of the fixing screw member 7 which is rotatably inserted into the throughhole 14 of the front driving lever 4 is screwed into the female screw 3*a* of the rear driving lever 3 so that the rear driving lever 3 and the front driving lever 4 are connected with each other. At this time, the coil spring 8 is gradually compressed. When the retaining member 9 is brought into contact with the front surface of the rear driving lever 3, the tightening force of the fixing screw member 7 is remarkably increased so that the sufficient tightening can be performed, and also the deflection of the rear driving lever 3 can be prevented. There is defined a slight gap between the head 7*a* of the fixing screw member 7 and the front surface of the front driving lever 4 in a state where the retaining member 9 is brought into contact with and retained by the front surface of the rear driving lever 3.

The normal or the reverse turning motion of the right looper shaft 2 in a given angular interval is transmitted to the rear driving lever 3 by way of the front driving lever 4 in a state where both driving levers 3 and 4 are connected with each other so that the rear driving lever 3 performs the swinging motion. The swinging motion of the rear driving lever 3 is transmitted to the right looper 1 by way of the right looper retainer 6 so that the right looper 1 can perform a given crossing motion.

When the overlock stitch is changed to the chain stitch so as to prevent the interference between the sewn product and the right looper 1, the operation of the right looper 1 is released. That is, the fixing screw member 7 is reversely turned so as to remove the male screw 7*c* from the female screw 3*a* of the rear driving lever 3. At that time, the screwing between the male screw 7*c* of the fixing screw member 7 and the female screw 3*a* of the rear driving lever 3 is released so that the fixing screw member 7 is elastically returned forward owing to the resiliency of the coil spring 8. The position where the fixing screw member 7 is returned is restricted when the retaining member 9 is brought into contact with and retained by the rear surface of the front driving lever 4. As a result, it is possible to prevent with assurance that the swinging motion of the front driving lever 4 is erroneously transmitted to the rear driving lever 3 by way of the fixing screw member 7. Accordingly, the swinging motion of the rear driving lever 3 is surely stopped so as to stop the right looper 1. Cylindrical rubber or a coned disc spring, etc., can be used instead of the coil spring 8.

As is understood from the above explanation, the fixing screw member is biased by the elastic member so as to be removed from the rear driving lever. Accordingly, when the right looper is intended to be released, it can be released with assurance by merely loosening the fixing screw member. As a result, it is preferably prevented that the right looper is erroneously operated owing to the retention between the fixing screw member and the rear driving lever.

According to the second aspect of the invention, although the fixing screw member is needed to be tightened so as to connect the rear driving lever to the front driving lever when the right looper is driven, it is possible to prevent an excessive tightening owing to the restriction of the retaining member which is attached to the fixing screw member. Accordingly, the rear driving lever does not generate deflection thereon, which dispensed with payment of attention to a tightening torque. As a result, the tightening operation of the fixing screw member can be remarkably improved.

What is claimed is:

1. A right looper release mechanism in an overlock sewing machine comprising:

a vertically movable needle having a needle thread;

a right looper 1 disposed under the vertically movable needle and reciprocally movable in a direction crossing the vertically movable needle 25;

a rear driving lever attached to the right looper and engaged in a right looper shaft so as to be freely turned relative thereto;

a front driving lever fixed to the right looper shaft;

a fixing screw member inserted in a throughhole of the front driving lever so as to be freely turned, said fixing screw member having a male screw being screwed into a female screw of the rear driving lever so as to transmit a motion of the right looper shaft to the right looper by way of the front driving lever and the rear driving lever; and an elastic member for elastically biasing the fixing screw member away from the female screw of the rear driving lever after the fixing screw member is disengaged from the female screw.

2. A right looper release mechanism in an overlock sewing machine according to claim 1 further comprising a retaining member provided on the fixing screw member, the retaining member being retained in front of the rear driving lever for restricting the amount by which the male screw of the fixing screw member can be threaded into the female screw of the rear driving lever.

* * * * *